US010093513B2

(12) United States Patent
Graber et al.

(10) Patent No.: US 10,093,513 B2
(45) Date of Patent: Oct. 9, 2018

(54) FOLDING APPARATUS AND METHOD

(71) Applicant: HUNKELER AG, Wikon (CH)

(72) Inventors: Kurt Graber, Brittnau (CH); Friedrich Faulhaber, Wellendingen (DE)

(73) Assignee: HUNKELER AG, Wikon (CH)

( * ) Notice: Subject to any disclaimer, the term of this patent is extended or adjusted under 35 U.S.C. 154(b) by 0 days.

(21) Appl. No.: 15/012,472

(22) Filed: Feb. 1, 2016

(65) Prior Publication Data

US 2016/0244291 A1 Aug. 25, 2016

(30) Foreign Application Priority Data

Feb. 19, 2015 (EP) ..... 15000482

(51) Int. Cl.

| | |
|---|---|
| ***B65H 37/06*** | (2006.01) |
| ***B65H 45/18*** | (2006.01) |
| ***B65H 45/28*** | (2006.01) |
| ***B42C 1/12*** | (2006.01) |
| ***B65H 39/10*** | (2006.01) |
| ***B65H 45/22*** | (2006.01) |

(52) U.S. Cl.

CPC ..... *B65H 37/06* (2013.01); *B42C 1/125* (2013.01); *B65H 39/10* (2013.01); *B65H 45/18* (2013.01);

(Continued)

(58) Field of Classification Search

CPC ..... B65H 37/06; B65H 39/10; B65H 45/18; B65H 45/22; B65H 45/28; B65H 45/2301;

(Continued)

(56) References Cited

U.S. PATENT DOCUMENTS 4,905,977 A * 3/1990 Vijuk ..... B65H 39/043 270/32
6,074,332 A 6/2000 Helmstadter et al.

(Continued)

FOREIGN PATENT DOCUMENTS

DE 3120526 A1 6/1982
DE 19606821 A1 8/1997

(Continued)

OTHER PUBLICATIONS

Aug. 28, 2015 Search Report issued in European Patent Application No. 15 00 0482.

(Continued)

*Primary Examiner* — Matthew G Marini
*Assistant Examiner* — Marissa Ferguson Samreth
(74) *Attorney, Agent, or Firm* — Oliff PLC

(57) ABSTRACT

An apparatus for folding sheets or sheet stacks, including at least two folding/transport rollers, transport device and knife, the transport device defining transport plane E for sheets or sheet stacks fed in transport direction R, knife being movable substantially perpendicularly to and through transport plane E, folding/transport rollers being arranged above transport plane E, oppositely on both sides of knife, axis of rotation A of folding/transport rollers extending substantially perpendicularly to transport plane E, and at least two folding/transport rollers each having, at their end facing toward transport plane E, rounded portion, such that narrowing gap S is formed between the at least two folding/transport rollers, into which gap sheets or sheet stacks can be introduced by means of knife so as to be folded there and at same time conveyed away in transport direction R, and to corresponding method.

10 Claims, 11 Drawing Sheets

(52) U.S. Cl.
CPC ..... *B65H 45/22* (2013.01); *B65H 45/28* (2013.01); *B65H 2301/45* (2013.01); *B65H 2301/51232* (2013.01); *B65H 2701/13212* (2013.01); *B65H 2801/15* (2013.01); *B65H 2801/31* (2013.01)

(58) Field of Classification Search
CPC ..... B65H 45/45; B65H 2301/51232; B65H 2701/13212; B65H 2801/15; B65H 2801/31; B42C 1/125
See application file for complete search history.

(56) References Cited

U.S. PATENT DOCUMENTS

| | | | |
|---|---|---|---|
| 2002/0065183 | A1 | 5/2002 | Luthi et al. |
| 2002/0065184 | A1 | 5/2002 | Graber et al. |
| 2008/0175691 | A1 | 7/2008 | Wetzel et al. |
| 2011/0187802 | A1 | 8/2011 | Fujio et al. |

FOREIGN PATENT DOCUMENTS

| | | | | |
|---|---|---|---|---|
| DE | 102006000989 | A1 | | 7/2007 |
| DE | 102011002771 | A1 | | 8/2011 |
| EP | 0846573 | A1 | | 6/1998 |
| EP | 1209000 | A1 | | 5/2002 |
| EP | 1213245 | A1 | | 6/2002 |
| FR | 2461671 | A1 | | 2/1981 |
| GB | 190221170 | | * | 7/1903 |

OTHER PUBLICATIONS

Jan. 25, 2016 Search Report issued in European Patent Application No. 15189597.6.

* cited by examiner

FOLDING APPARATUS AND METHOD

The invention relates to an apparatus for folding sheets or sheet stacks and also to a corresponding method. The invention also relates to a method for producing a newspaper product from at least one first and one second sub-product.

A folding apparatus and a method for producing an omega-shaped fold are known from EP 0 846 573 A1. Once an incoming sheet or sheet stack has been lifted centrally using a knife, the fold is produced by two jaws movable relative to one another. The folded product is ejected from the folding region in the direction of the fold edge once the jaws have been opened.

An apparatus and a method for folding sheets, in particular printed paper sheets, is known from EP 1 213 245 A1, comprising a knife which has a straight upper edge located in a feed plane and movable perpendicularly to the feed plane, and comprising two folding elements for forming a fold. The folding elements in this case are at least two folding rollers, which are arranged parallel to the feed plane and of which the axes of rotation each extend parallel to the fold edge. Furthermore, at least two conveying-away rollers are provided, of which the axes of rotation extend perpendicularly to the feed plane and which are arranged on the side of the folding rollers facing away from the feed plane and/or to the side of the folding rollers. This apparatus and the corresponding method have proven to be very reliable, in particular when folding individual sheets. Since the folding and the conveying away process are performed at right angles to one another, such that a corresponding deflection of the sheets is necessary, a relatively long period of time is required for the folding and conveying away of the sheets.

One object of the present invention is therefore to provide an apparatus and a method with which the processing speed can be increased efficiently. A further object of the present invention is to specify a method by means of which a newspaper product composed of at least two sub-products having different sheet lengths can be produced particularly efficiently.

The object is achieved in accordance with the invention by an apparatus for folding sheets or sheet stacks, comprising at least two folding/transport rollers, a transport device and a knife, the transport device defining a transport plane for sheets or sheet stacks fed in a transport direction, the knife being movable substantially perpendicularly to and through the transport plane, the folding/transport rollers being arranged above the transport plane, oppositely on both sides of the knife, the axis of rotation of the folding/transport rollers extending substantially perpendicularly to the transport plane, and the at least two folding/transport rollers each having, at their end facing toward the transport plane, a rounded portion, such that a narrowing gap is formed between the at least two folding/transport rollers, into which gap the sheets or sheet stacks can be introduced by means of the knife so as to be folded there and at the same time conveyed away in the transport direction, and by a method for folding sheets or sheet stacks, by means of at least two folding/transport rollers, a transport device and a knife, the transport device defining a transport plane for sheets or sheet stacks fed in a transport direction, the knife being movable substantially perpendicularly to and through the transport plane, the folding/transport rollers being arranged above the transport plane, oppositely on both sides of the knife, and the method comprising at least the following steps: (a) feeding a sheet or a sheet stack by means of the transport device in the transport direction; (b) moving the knife positioned below the transport plane into contact with the sheet or sheet stack located in the transport plane; (c) lifting the sheet or the sheet stack by means of the knife and introducing the sheet or the sheet stack into a gap formed between the folding/transport rollers; and (d) folding and at the same time conveying away the sheet or the sheet stack in the transport direction through the gap formed between the folding/transport rollers.

The present invention is suitable both for folding individual sheets and for folding sheet stacks, the invention preferably being used in conjunction with the folding of sheet stacks, since here the folding accuracy in some circumstances does not need to be as high as in the case of individual sheets. Nevertheless, however, the folding accuracy that can be attained with the present invention is also completely sufficient for individual sheets.

The sheet length and the sheet width are variable here within wide ranges without having to convert the apparatus.

The feed rate of the sheets or sheet stack can also be variable.

In addition, the number of sheets in a sheet stack and the thickness of the individual sheets in a sheet stack are variable.

The number of sheets in a stack is preferably 2 to 25 and particularly preferably 4 to 12.

The sheets or sheet stack are/is usually longitudinally folded in accordance with the invention, however an additional transverse fold is also possible.

In particular, the sheets or sheet stack can be folded in accordance with the invention without significant change to the movement speed and without a change to the transport direction, which leads to higher processing speeds and shorter clock cycles, and prevents a shifting of the individual sheets in a sheet stack.

In a preferred embodiment of the present invention the rounded portions of the folding/transport rollers have a spherical washer-shaped embodiment. This means that, as considered in cross section, the rounded portions of two mutually opposed folding/transport rollers run toward one another in the manner of two asymptotes and thus form therebetween the narrowing gap.

A conical embodiment, however, of the rounded portions is also conceivable. In particular, the side of the rounded portions of the folding/transport rollers facing toward the transport plane is flattened (i.e. in any case is not completely round) in order to minimize the depth of penetration of the knife in the gap or between the folding/transport rollers and thus enable a quicker movement in the transport direction. If the folding/transport holders were completely rounded or pointed at their lower end, the depth of penetration of the knife would necessarily be greater, and therefore the cycle time would be longer.

The depth of penetration of the knife in the gap formed between the folding/transport rollers is preferably approximately 3 to 12 mm, particularly preferably 5 to 10 mm. In this way, the clock cycle can be minimized or further optimized.

The knife is preferably as thin as possible so that the folding/transport rollers during the folding process are to be moved away from one another to the shortest possible extent. The knife is generally thin and pointed, it being slightly flattened at its upper end (or its upper edge). The knife is thus prevented from cutting into the paper.

In a further preferred embodiment of the present invention the folding/transport rollers are spring-mounted, preferably transversely to the transport direction. They may therefore move passively relative to one another. When the knife is moved with a sheet or a sheet stack between the folding/transport rollers, it pushes the individual rollers of a pair away from one another, and these move together again when the knife is moved back again. In addition, an active movement of the folding/transport rollers, i.e. via a drive, is also conceivable—potentially by exact control of the gap during the folding process, in order to pre-set the gap on account of the thickness of the stack to be folded, or in order to improve the fold quality by pressing of the folding/transport rollers as the stack is conveyed away after the folding.

In yet a further preferred embodiment of the present invention the knife is hinged to at least two belt pulleys (or drive rollers). The hinged connection is routinely established by means of a connection piece, which is fixedly engaged with an underside of the knife and which is screwed in each case to the associated belt pulley (or drive roller).

In yet a further preferred embodiment of the present invention the belt pulleys (or drive rollers), which generate the stroke of the knife, are driven at constant rotational speed, in particular during the folding process. However, the rotational speed of the belt pulleys (or drive rollers) is particularly preferably controlled in such a way that a substantially constant horizontal movement of the knife during the folding process results. A further process optimization can thus be achieved, and a shifting of individual sheets in the stack can be prevented.

In yet a further preferred embodiment of the present invention the transport device is embodied in the form of two conveyor belts running parallel to one another. A particularly reliable feed of the sheets or sheet stack can be ensured in this way.

In yet a further preferred embodiment of the present invention a glue head is arranged downstream of the folding/transport rollers. A strip of glue is applied by means of the glue head onto the folding edge of a sheet or sheet stack. This is necessary in particular when a number of folded stacks have to be glued to one another or when a cover for example is to be glued onto a folded stack.

As considered in the transport direction, a pair of pressing rollers is preferably also provided after the folding/transport rollers, but before the glue head, and serves to (again) press together the fold. A pair of holding rollers is preferably also arranged downstream of the glue head and helps to prevent a dipping of the folded sheet or sheet stack during the gluing process and thus ensures that the folded sheet or sheet stack exits the apparatus with a straight alignment.

In yet a further preferred embodiment of the present invention a light barrier is arranged upstream of the folding/transport rollers for detection of the rear edge of a sheet or a sheet stack. The detection of the rear edge of a sheet or a sheet stack preferably triggers a movement or a stroke of the knife. It is thus ensured that two sheets or sheet stacks which enter the apparatus at a short distance from one another can nevertheless be processed in a precise manner. The gaps between the sheets or sheet stacks may thus be kept as small as possible, which leads to a further process optimization.

In yet a further preferred embodiment of the method according to the invention the sheets or sheet stack are/is weakened before or during the feed according to step (a) or during the folding and simultaneous conveying away according to step (d), in particular in order to avoid a skewed formation of the fold. Here, the weakening can be performed in various ways. The sheets or sheet stack can be grooved along the desired fold line (scoring). The sheets or sheet stack, however, may also be perforated accordingly. It is also conceivable to apply a line of water droplets along the desired fold line in order to temporarily weaken the paper.

A further object of the invention lies in the practically simultaneous production of a newspaper consisting of one or more bundles/sections (or sub-products) in each case of the same or different format, with a brochure (as further sub-product) inserted into the newspaper, the individual sheets of said brochure being periodically fixedly connected to one another (for example by means of gluing).

By contrast, the newspaper and the brochure are each printed separately in conventional methods, and the sub-products are brought together in a separate step (the brochure is subsequently inserted into the newspaper).

The object is achieved in accordance with the invention by a method for producing a newspaper product formed from at least one first and one second sub-product, the first sub-product being formed from sheets having a length $L_1$ and the second sub-product being formed from sheets having a length $L_2$, the method comprising at least the following steps: (a) printing the individual sheets for the first and second sub-product, preferably on a paper web and preferably by means of digital printing; (b) separating the sheets and collating the sheets in at least one stack for the first sub-product and at least one stack for the second sub-product; (c) preferably transversely folding the stack comprising the sheets for the second sub-product; (d) longitudinally folding the collated stack for the first and second sub-product; (e) collating the individual stacks to form a newspaper product; and (f) preferably conveying away the finished newspaper product, preferably in a stream delivery.

It is made possible in this way for the individual parts or sub-products of the newspaper, i.e. inclusive of the insert brochure) to be printed with one another on the same printer and at the same time on the same paper roll and then to be processed jointly. The printing is preferably performed by means of a digital printing machine and can be carried out both in-line and off-line. Printing is preferably performed onto a roll of endless paper. However, it is also conceivable to feed individual sheets. In the latter case it is also conceivable to use different types or sorts of paper for the different sub-products.

In a preferred embodiment of the present invention the printed paper web is temporarily stored after the printing according to step (a) in order to be further processed later where appropriate.

When separating the sheets according to step (b), the sheets are preferably transversely cut and then directly collated. Here, further processing steps may optionally be carried out during the cutting and/or collating, for example a covering of the sheets (coating), a trimming of the sheets (longitudinal trim of the sheets), or a gluing of the sheets. The sheets and transverse cutting (separating) may optionally also be carried out on the collation unit.

A transverse folding of the collated stack is preferably provided for the broadsheet newspaper format (optional step (c)).

In the event of longitudinal folding of the collated stack according to step (d), the individual sheets of the stack may optionally be connected to one another, for example by means of staples or a thread (thread binding).

In a further preferred embodiment of the method according to the invention for producing a newspaper product, the sheets or stacks are weakened before or during one of the steps (b), (c) or (d), in particular in order to avoid a skewed formation of the fold. Here, the weakening can be performed in various ways. The sheets or stacks can be grooved along the desired fold line (scoring). The sheets or stacks may also be perforated accordingly. It is also conceivable to apply a line of water droplets along the desired fold line in order to temporarily weaken the paper.

In a further preferred embodiment of the present invention the individual stacks are connected to one another during the collation according to step (e). The individual stacks are preferably collated on a saddle. Here, the stacks are collated in a saddle-shaped manner and glued to one another where appropriate.

The optional conveying away of the finished newspaper products according to step (f) is preferably carried out in what is known as a stream delivery. In a further optional step the finished newspaper product is clipped, i.e. trimmed at its edges, before or after being conveyed away.

In yet a further preferred embodiment of the present invention the length $L_2$ of the sheets for the second sub-product is greater, preferably twice as great, as the length $L_1$ of the sheets for the first sub-product. This is associated with the fact that large newspapers (what is known as broadsheet format) are folded twice, i.e. once longitudinally and once transversely. Small newspapers (what is known as tabloid format) by contrast are folded only once (longitudinally). Both formats can be produced in a mixed manner by means of the method according to the invention and can be compiled to form a common end product.

The accompanying drawings serve to illustrate the invention and in this respect constitute merely preferred embodiments of the present invention.

In the drawings:

FIG. 1*a* shows a schematic perspective view of the apparatus according to the invention for folding sheets or sheet stacks;

FIG. 1*b* shows a schematic side view of the apparatus according to the invention the folding sheets or sheet stacks;

FIG. 1*c* shows a schematic front view of the apparatus according to the invention for folding sheets or sheet stacks;

FIG. 2*a* shows a schematic perspective view of a detail of the apparatus according to the invention for folding sheets or sheet stacks in a first position;

FIG. 2*b* shows a schematic side view of a detail of the apparatus according to the invention the folding sheets or sheet stacks in a first position;

FIG. 2*c* shows a schematic front view of a detail of the apparatus according to the invention the folding sheets or sheet stacks in a first position;

FIG. 3*a* shows a schematic perspective view of a detail of the apparatus according to the invention for folding sheets or sheet stacks in a second position;

FIG. 3*b* shows a schematic side view of a detail of the apparatus according to the invention for folding sheets or sheet stacks in a second position;

FIG. 3*c* shows a schematic front view of a detail of the apparatus according to the invention for folding sheets or sheet stacks in a second position;

FIG. 4*a* shows a schematic perspective view of a detail of the apparatus according to the invention for folding sheets or sheet stacks in a third position;

FIG. 4*b* shows a schematic side view of a detail of the apparatus according to the invention for folding sheets or sheet stacks in a third position;

FIG. 4*c* shows a schematic front view of a detail of the apparatus according to the invention for folding sheets or sheet stacks in a third position;

FIG. 5*a* shows a schematic perspective view of a detail of the apparatus according to the invention for folding sheets or sheet stacks in a fourth position;

FIG. 5*b* shows a schematic side view of a detail of the apparatus according to the invention for folding sheets or sheet stacks in a fourth position; and FIG. 5*c* shows a schematic front view of a detail of the apparatus according to the invention for folding sheets or sheet stacks in a fourth position;

FIG. 6*a* shows a schematic perspective view of a detail of the apparatus according to the invention for folding sheets or sheet stacks in a fifth position;

FIG. 6*b* shows a schematic side view of a detail of the apparatus according to the invention for folding sheets or sheet stacks in a fifth position;

FIG. 6*c* shows a schematic front view of a detail of the apparatus according to the invention for folding sheets or sheet stacks in a fifth position;

FIG. 7 shows a schematic perspective view of a processing line for the method according to the invention for producing a newspaper product;

FIG. 8*a* shows an exemplary paper web for the method according to the invention in a processing line according to FIG. 7;

FIG. 8*b* shows an exemplary paper roll for the method according to the invention in a processing line according to FIG. 7;

Figure 12A:
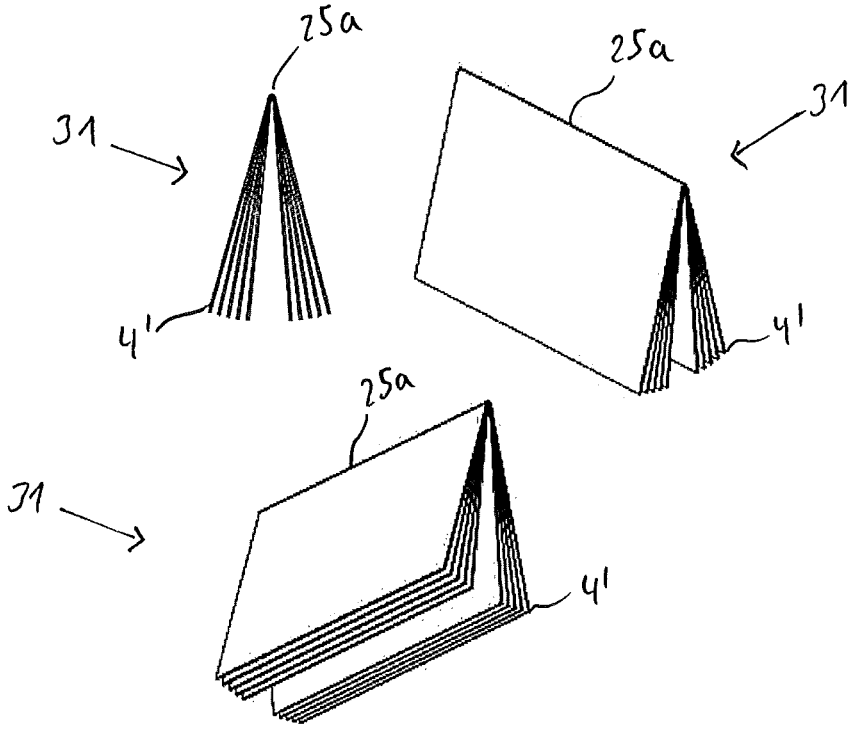
Figure 12B:
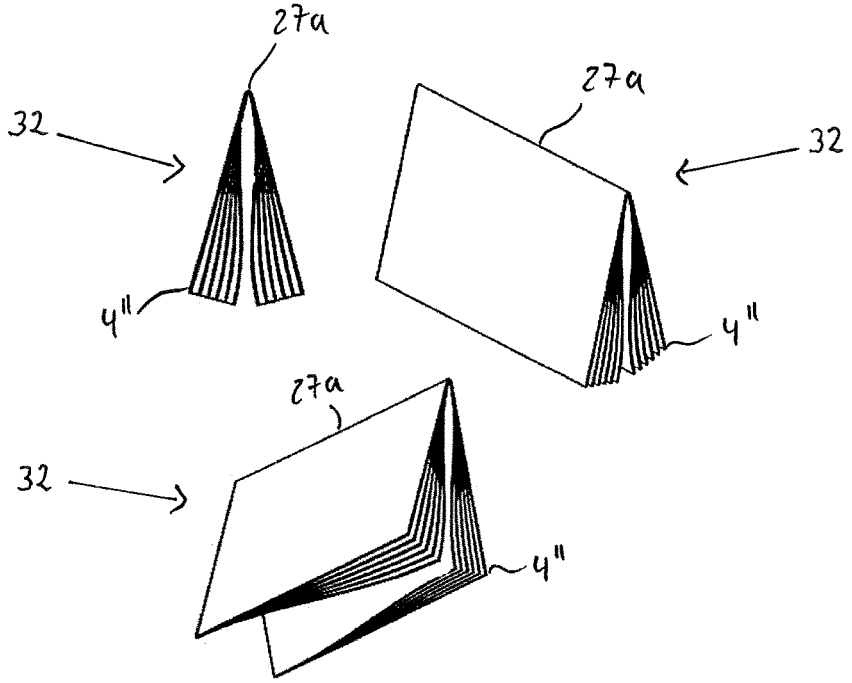
Figure 13:
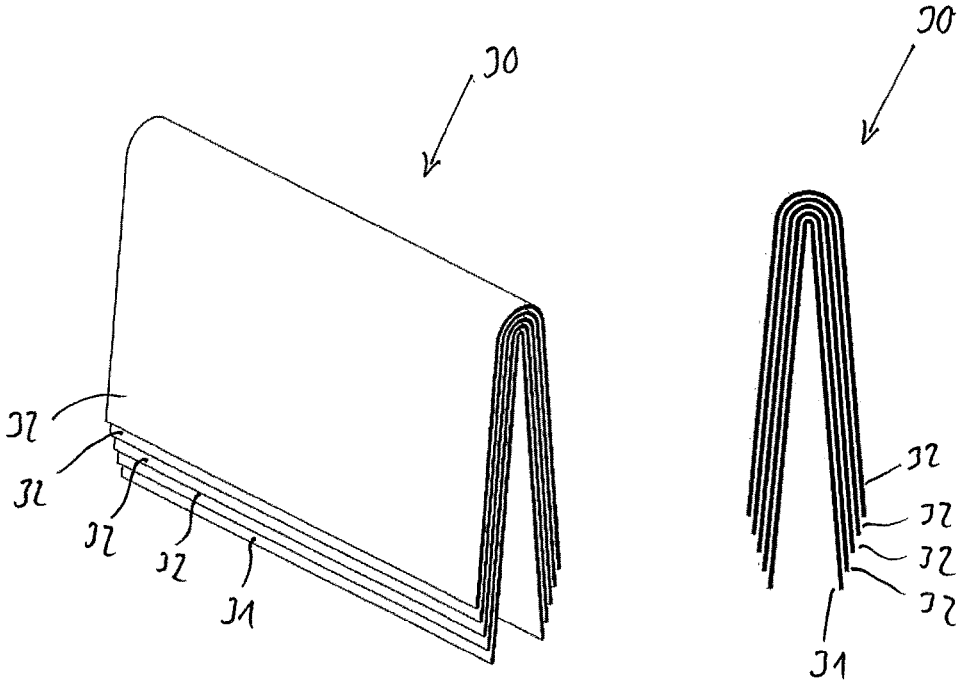
Figure 14:
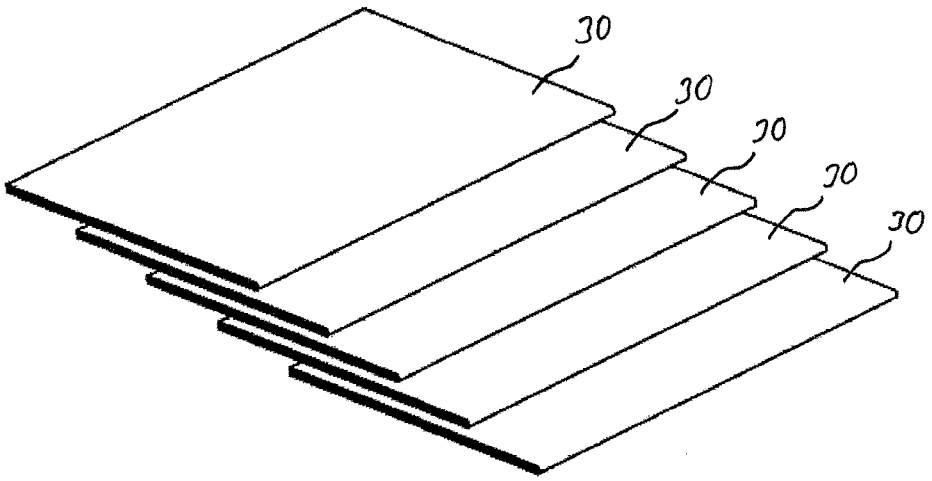

FIG. 12*a* shows views of a first sub-product from different perspectives;

FIG. 12*b* shows views of a second sub-product from different perspectives;

FIG. 13 shows views of a finished newspaper product from different perspectives;

FIG. 14 shows a number of finished newspaper products when conveyed away in stream delivery.

Figure 1A:
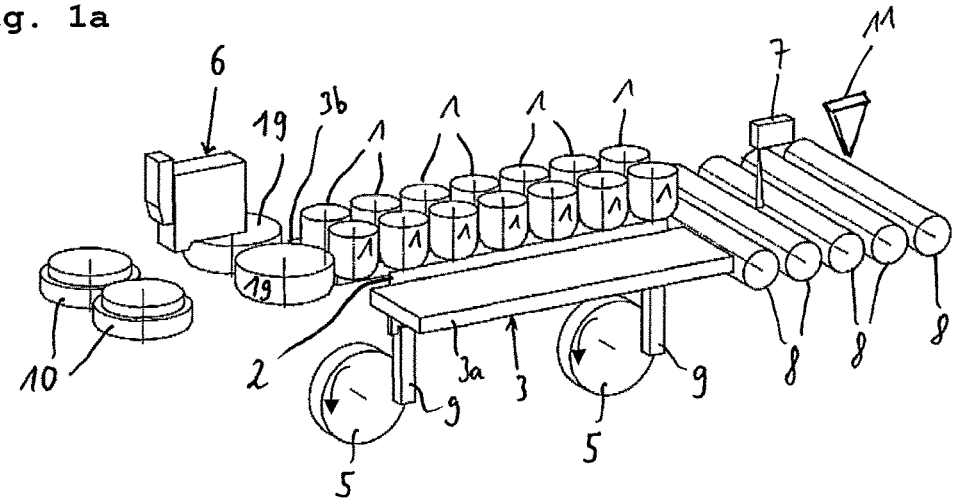

FIG. 1*a* shows a schematic, perspective view of the apparatus according to the invention for folding sheets or sheet stacks, but here not yet with a sheet or a sheet stack.

The feed rollers for the sheets or sheet stack are designated by reference sign 8. A weakening apparatus for the incoming sheets or sheet stack is provided above the feed rollers 8 and serves to weaken the paper before the folding and thus make the paper easier to fold. Here, this may be on the one hand an apparatus for forming a groove along the desired fold line (scoring) or may be a perforating apparatus. It is additionally also possible for a line of water droplets to be sprayed onto the paper by means of the weakening apparatus 11 in order to temporarily weaken the paper. However, it is also possible for the weakening of the paper to be carried out suitably during the folding process. As a result of the weakening it is possible to very efficiently prevent a skewed fold, which leads to a significant increase of the quality of the finished product.

A light barrier 7 is also provided downstream of the weakening apparatus 11, but still in the region of the feed rollers 8. The light barrier 7 serves to detect the rear edge of a sheet or a sheet stack and triggers a movement of the knife 2 (in this respect the light barrier 7 is of course connected to a corresponding control unit, which is not shown here for reasons of simplicity).

The knife 2 is connected via the connection piece 9 to each of the drive rollers 5 (generally belt pulleys) or is hinged thereto. The drive rollers 5 are driven in the direction shown by the respective arrows (i.e. in the present case in an anti-clockwise direction).

The knife 2 is arranged between two conveyor belts 3*a* and 3*b* of a transport device 3, such that it can engage substantially centrally with the fed sheets. A number of pairs of mutually opposed folding/transport rollers 1 are arranged above the transport device 3 and serve to fold and simultaneously convey the sheets or sheet stack. In a preferred embodiment the conveyor belts 3*a*, 3*b* may also extend upstream beyond the folding/transport rollers 1 and where appropriate may thus take over the function of the feed rollers 8 wholly or at least in part.

A pair of pressing rollers 19 is provided downstream of the folding/transport rollers 1 and serves to again press the previously formed fold together or against itself and thus contributes to an increase of the quality of the fold. A glue head 6 is arranged downstream of the pressing rollers 19, by means of which glue head a line of glue can be applied to the fold edge of the respective sheet or sheet s tack.

Lastly, a pair of holding rollers 10 is also provided downstream of the glue head 6. The holding rollers 10 serve to prevent a dipping of the folded sheet or sheet stack during the gluing. It is thus ensured that the folded sheet or sheet stack comes out of the apparatus with a straight alignment.

Figure 1B:
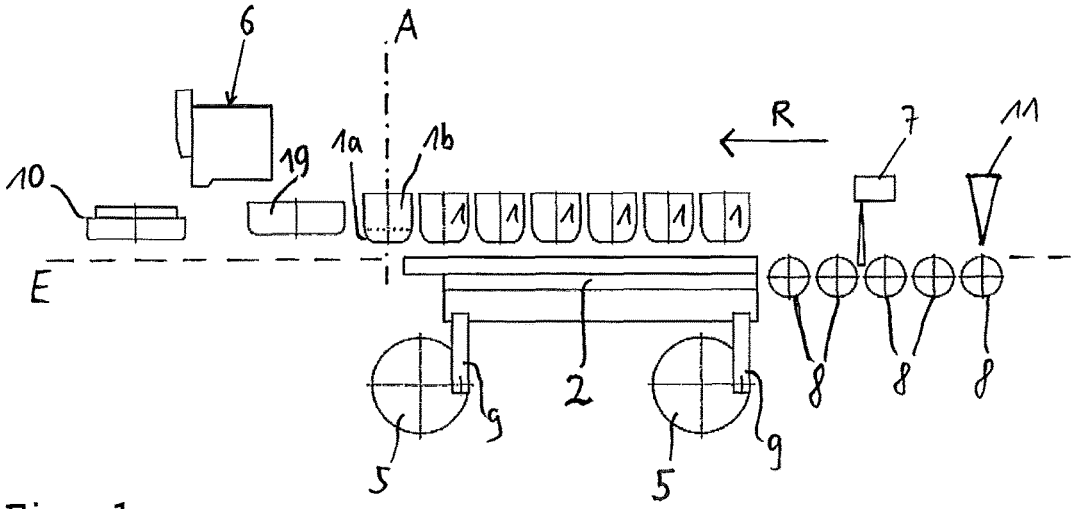

In FIG. 1*b* like reference signs designate the same components, and this is also true for the remaining description of the figures. In this side view the transport plane E for the sheets or sheet stack to be processed can be seen in particular. The transport plane E is defined here substantially by the surface of the conveyor belts 3*a*, 3*b* of the transport device 3 and where appropriate also by the virtual upper side of the feed rollers 8. The axis of rotation A of the folding/transport rollers 1 extends perpendicularly to the transport plane E. The axis of rotation A is indicated here merely by way of example for one of the folding/transport rollers, however it extends in the same way in the case of the rest of the folding/transport rollers 1. Again by way of example, the folding/transport roller 1 positioned farthest to the left in the transport direction R is illustrated in a divided manner, more specifically divided into its rounded portion 1*a* and the cylindrical portion 1*b* (this embodiment will be explained further below in greater detail). It can additionally be clearly seen that the glue from the glue head 6 is applied once the sheet or sheet stack has passed through the pressing rollers 19, but before entry into the holding rollers 10.

Figure 1C:
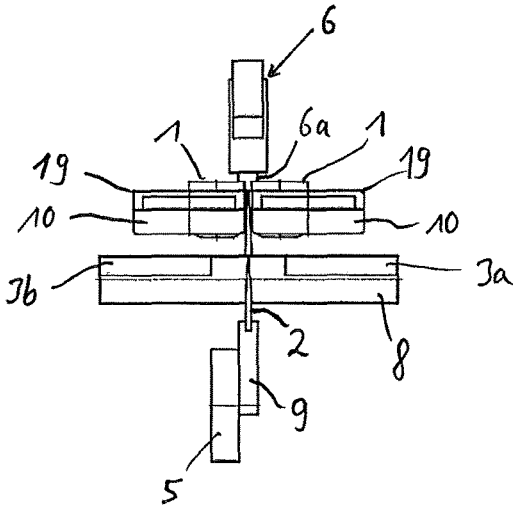

In the front illustration according to FIG. 1*c*, it can be seen that the knife 2 hinged to the drive rollers 5 via the connection pieces 9 is arranged exactly centrally between the conveyor belts 3*a* and 3*b* and that the respective roller pairs, i.e. the holding rollers 10, the pressing rollers 19 and the folding/transport rollers 1, are arranged in each case oppositely on both sides of the knife 2. The glue head outlet 6*a* is arranged here such that the glue can pass precisely onto the fold of the sheets or sheet stack formed by the knife. The lower half of the feed rollers can also be seen beneath the conveyor belts 3*a* and 3*b*.

Figure 2A:
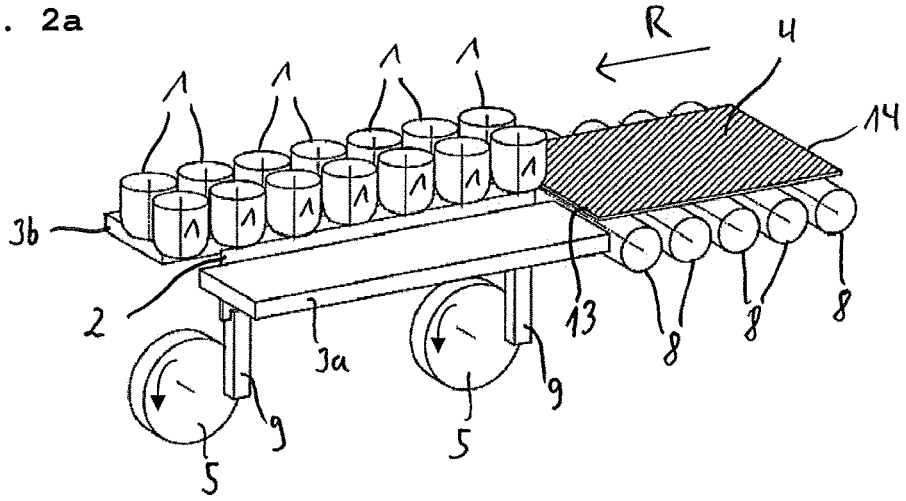

FIG. 2*a* shows a schematic, perspective view of a detail of the apparatus according to the invention for folding sheets or sheet stacks in a first position, in which a sheet or sheet stack 4 is fed by means of the feed rollers 8 to the transport device 3 or the two conveyor belts 3*a*, 3*b*. The rear edge 14 of the sheet or sheet stack 4 here has not yet passed the light barrier 7 shown in FIG. 1*a*; the front edge 13 is transferred first to the conveyor belts 3*a*, 3*b*. The knife 2 is thus in its starting position. The folding/transport rollers 1 are therefore also not yet engaged with the sheet or sheet stack 4. The connection pieces 9 hinged to the drive rollers 5 are located here in their right, middle position.

Figure 2B:
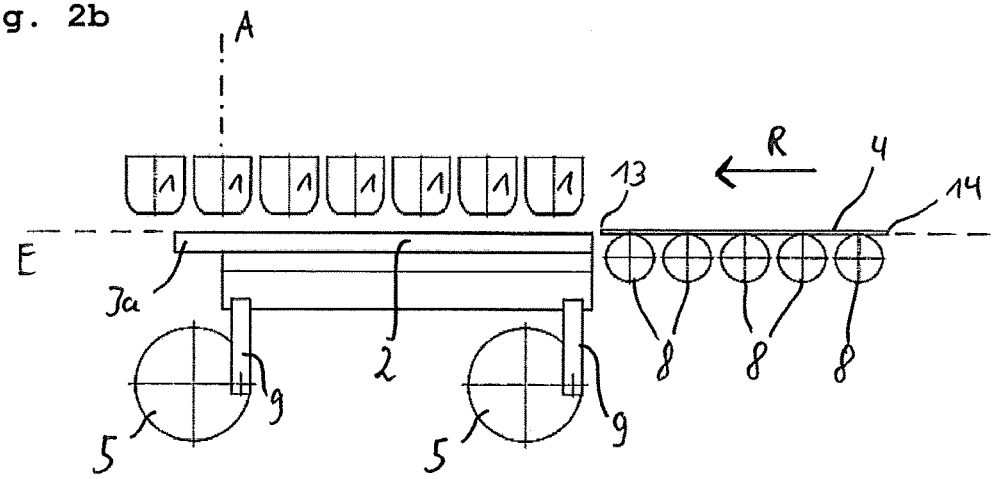

In FIG. 2*b* the geometric relationship between the transport direction R, the transport plane E and the axis of rotation A of the folding/transport rollers 1 is illustrated: the axis of rotation A is substantially at right angles to the transport plane E and to the transport direction R.

Figure 2C:
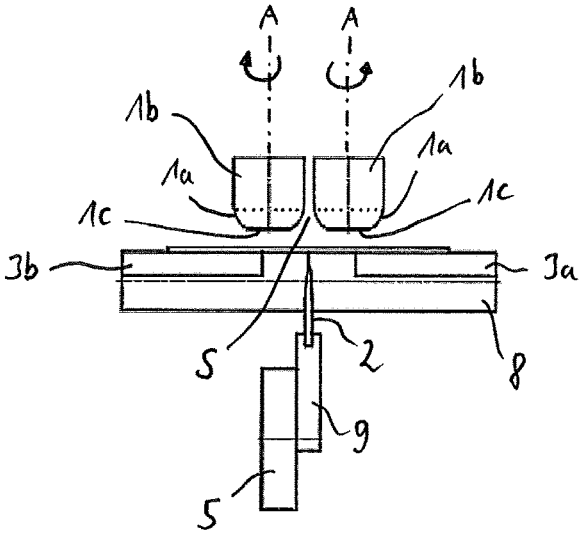

In FIG. 2*c* it can be seen that the upper edge or upper side of the knife 2 is arranged exactly below the underside of the incoming sheet or sheet stack 4. On the one hand the feed of the incoming sheet or sheet stack 4 therefore is not blocked, and on the other hand the knife 2 can come directly into engagement with the sheet or sheet stack 4 upon a corresponding signal from the light barrier 7 or the associated control unit.

A gap S is formed between the folding/transport rollers 1 via their rounded portions 1*a* and their cylindrical portions 1*b*, which gap narrows increasingly as viewed from bottom to top. The inner sides of the two folding/transport rollers illustrated in cross section form accordingly an asymptotic arrangement. The rounded portions 1*a* of the folding/transport rollers are spherical washer-shaped, such that they have a flattened region 1*c* on their underside. The flattened region 1*c* serves to prevent the knife 2 from having to penetrate too deeply between the folding/transport rollers 1 during operation. The direction of rotation of the axis of rotation A of the two folding/transport rollers 1 shown is opposite that specified by the two arrows.

Figure 3A:
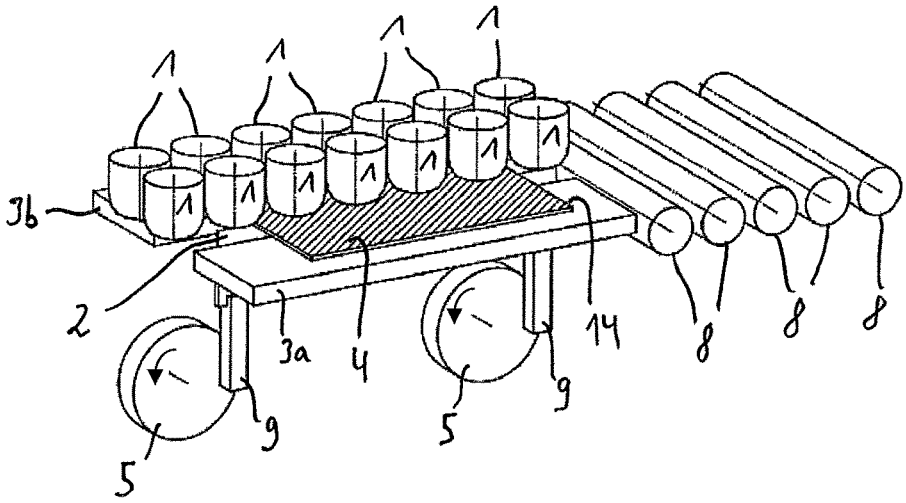
Figure 3B:
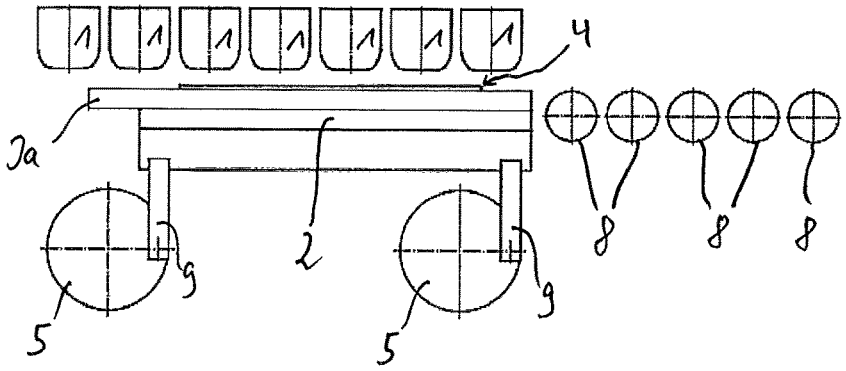
Figure 3C:
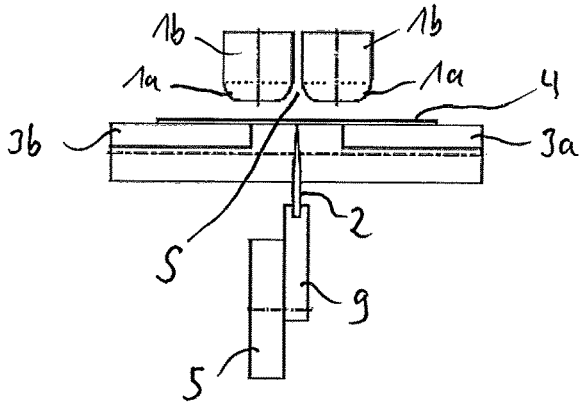

FIG. 3*a* shows a schematic, perspective view of a detail of the apparatus according to the invention for folding sheets or sheet stacks in a second position, in which the sheet or sheet stack 4 already rests completely on the conveying belts 3*a*, 3*b* of the transport device 3 (see also FIG. 3*b*). The rear edge 14 of the sheet or sheet stack 4 has thus passed the light barrier, such that the triggering of a movement of the knife 2 is immediately imminent, but has not yet occurred. The knife 2 bears almost directly against the underside of the sheet or sheet stack 4 (see FIG. 3*c*) and is ready to move this out of the transport plane E.

Figure 4A:
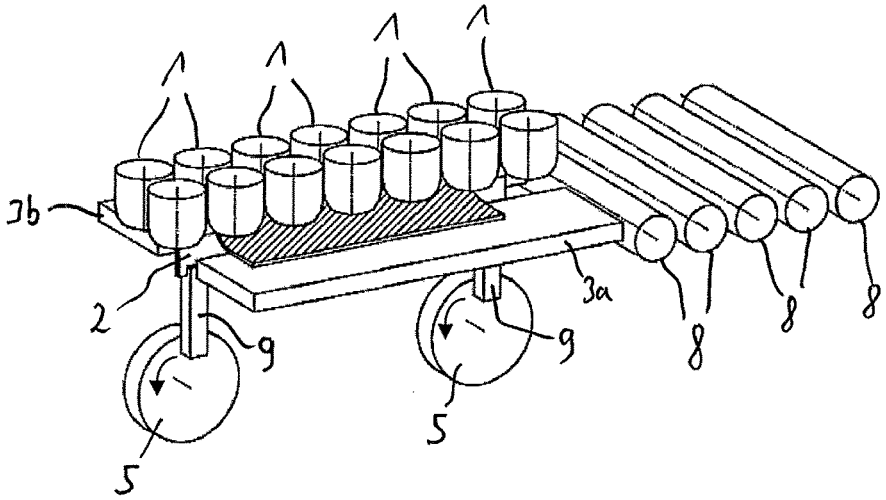
Figure 4B:
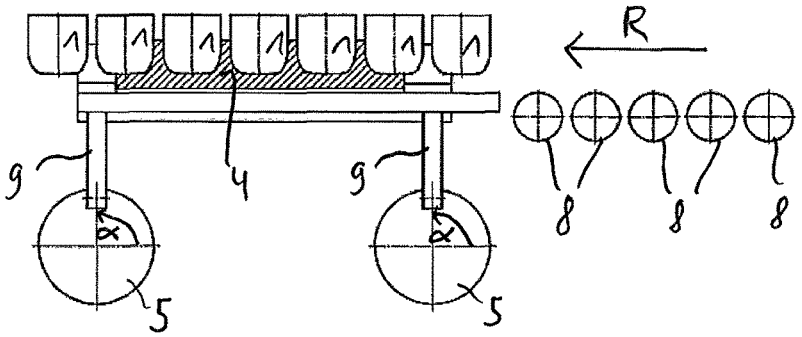
Figure 4C:
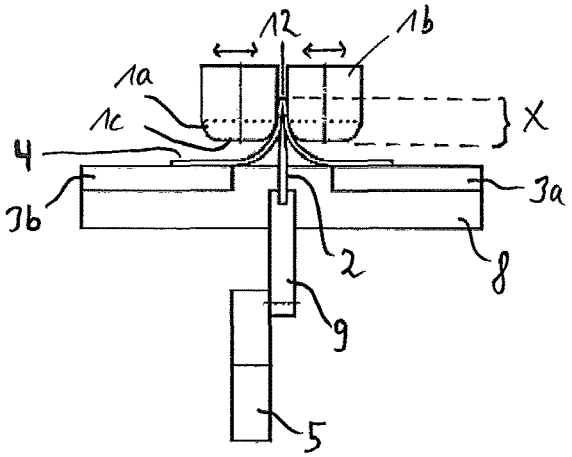

Schematic detail views of an apparatus according to the invention for folding sheets or sheet stacks in a third position, in which the knife 2 has now been moved, are now illustrated in FIGS. 4*a* to 4*c*. The drive rollers 5 or the connection pieces 9 hinged thereto have been moved into the uppermost position through a circular arc of 90° in the direction of rotation specified by the arrows, such that the knife 2 has moved or introduced the sheet or sheet stack 4 into the gap S between the folding/transport rollers 1. The folding/transport rollers 1 are preferably spring-mounted here, as specified by means of the double-headed arrow in FIG. 4*c*, such that they can move horizontally away from one another when the knife 2 together with the sheet or sheet stack 4 penetrates the gap S, or can move together again when the knife 2 and/or the sheet or sheet stack 4 are/is no longer located in the gap S.

The depth of penetration of the knife 2 into the gap S is designated by X (see FIG. 4*c*) and is generally measured from the underside or flattened region 1*c* of the folding/transport rollers 1 to the upper side or upper edge of the knife 2. The knife 2 here has reached its highest position between the folding/transport rollers 1, the upper side of the knife 2 protruding into the region between the cylindrical portions 1*b* of the folding/transport rollers 1, i.e. beyond the rounded portions 1*a*.

Figure 5A:
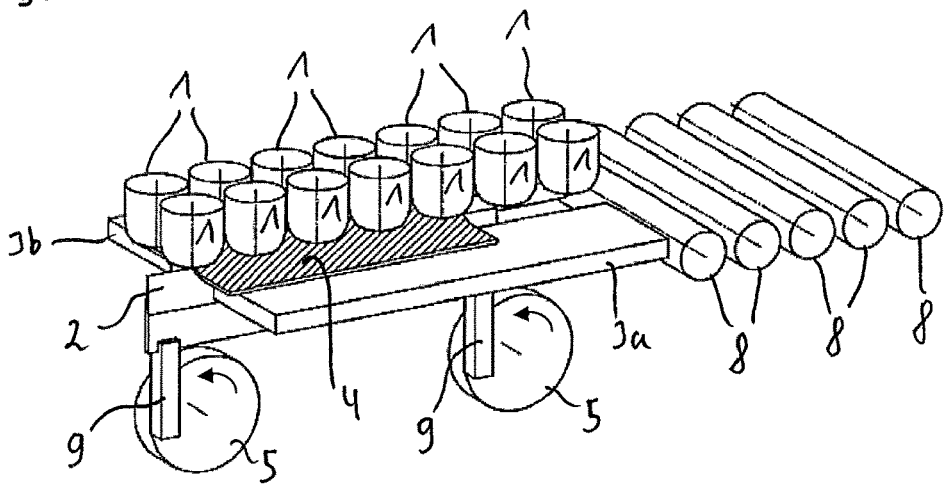
Figure 5B:
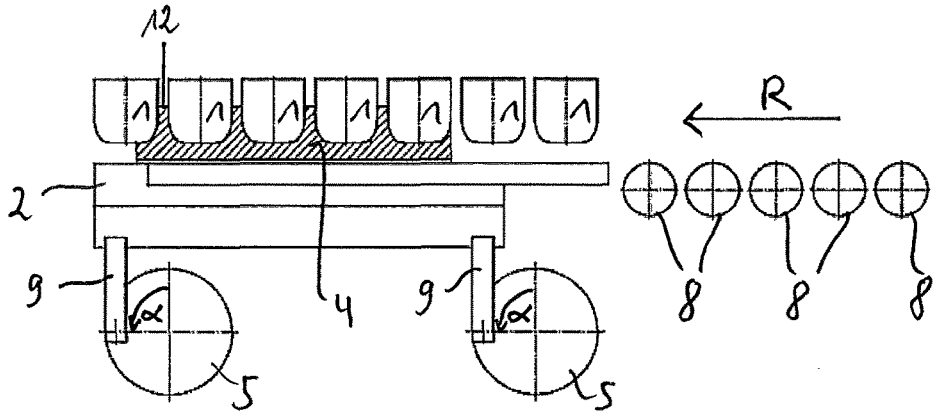
Figure 5C:
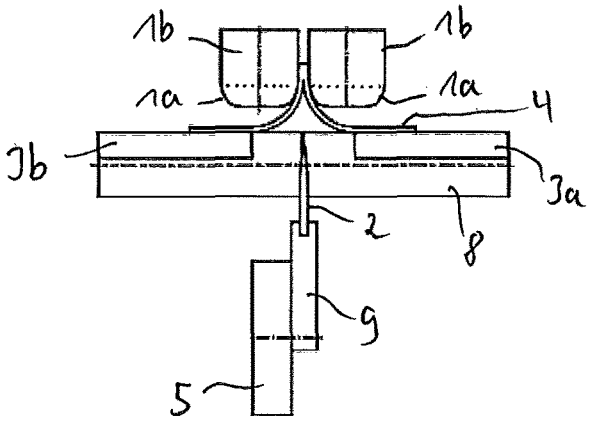

FIGS. 5*a* to 5*c* show schematic detail views of the apparatus according to the invention for folding sheets or sheet stacks in a fourth position, in which the knife 2 is no longer engaged with the sheet or sheet stack 4. The drive rollers 5 or the connection pieces 9 hinged thereto have continued to move in the arrow direction through a further circular arc α of 90° and are now located in their left middle position. The knife 2 is thus again directly beneath the transport plane E. The sheet or sheet stack 4 has been moved slightly further in the transport direction R by the folding/transport rollers 1 compared with the third position according to FIGS. 4*a* to 4*c* and at the same time has been folded, the fold 12 of the sheet or sheet stack 4 extending parallel to the transport plane E.

Figure 6A:
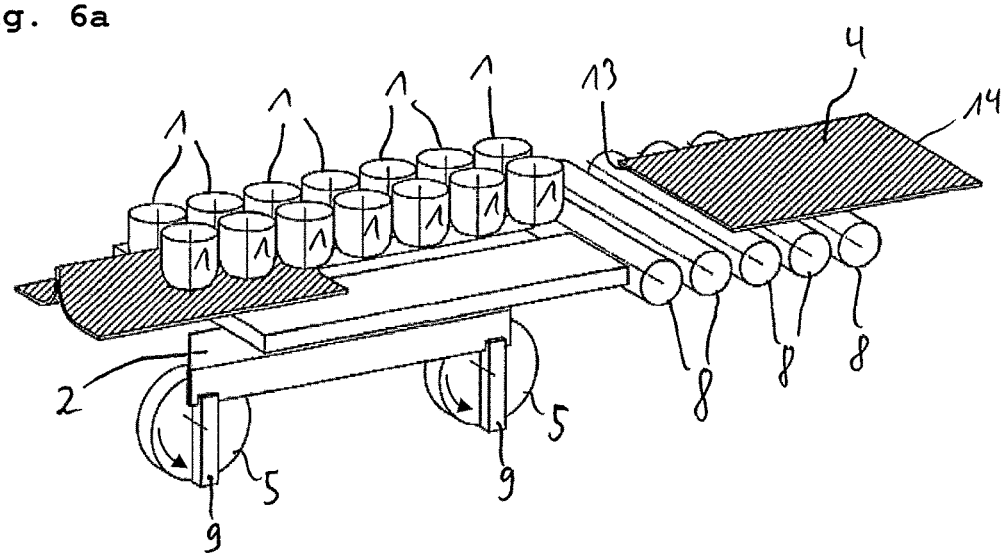
Figure 6B:
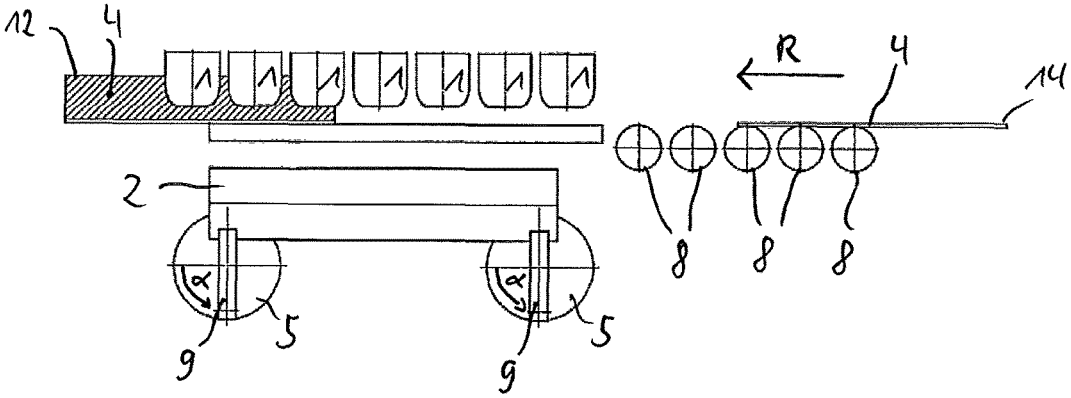
Figure 6C:
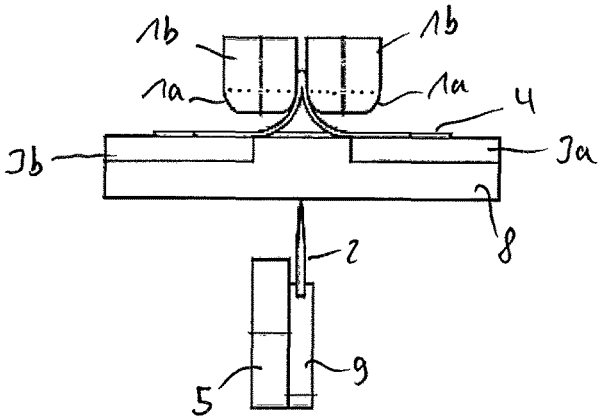

FIGS. 6*a* to 6*c* show lastly schematic detail views of the apparatus according to the invention for folding sheets or sheet stacks in a fifth position, in which the sheet or sheet stack 4 has been conveyed further in the transport direction R and at the same time has been folded, such that it is now engaged with the pressing rollers 19 and where appropriate the glue head 6 and the holding rollers 10, in accordance with FIGS. 1*a* to 1*c*. The fold 12 still runs parallel to the transport plane E. A further sheet or sheet stack 4 has already been transported by the feed rollers 8 in the direction of the conveyor belts 3*a* and 3*b*.

The drive rollers or belt pulleys 5 have continued to move through a further circular arc α of 90° (see arrows), such that the hinged connection piece 9 is in its lowermost position. The knife 2 has here likewise reached its lowermost position accordingly. In FIG. 6*c* it can be seen that the lower edge of the connection piece 9 is practically flush with the underside of the drive rollers or belt pulleys 5.

The knife 2 then passes from this position back into its starting position according to FIGS. 2*a* to 2*c* via a further movement along a circular arc α of 90°, in which starting position the front edge 13 of the next sheet or sheet stack 4 has arrived at the transport device 3 and the previous sheet or sheet stack 4 has in any case left the folding/transport rollers 1.

On account of the illustrated cooperation between the individual components of the apparatus according to the invention, the sheets or sheet stacks 4 are always transported in the same transport direction R, whereby high processing speeds and short clock cycles can be achieved.

Figure 7:
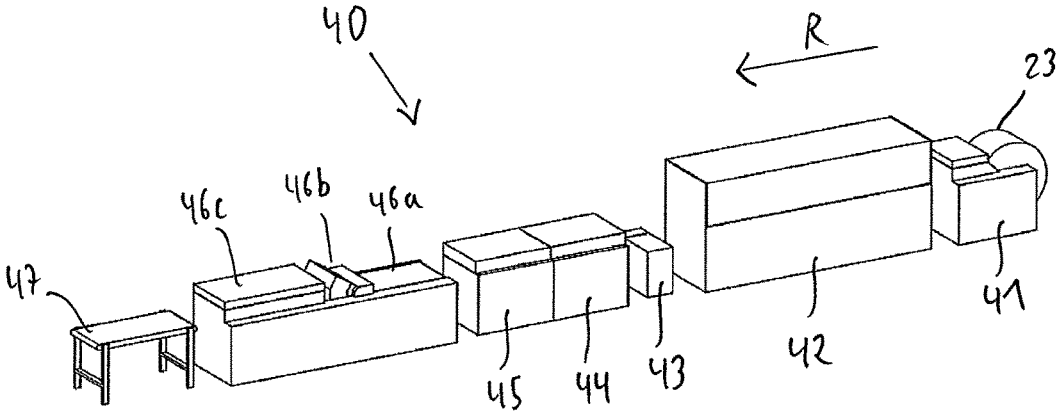

FIG. 7 shows a schematic perspective view of a processing line for the method according to the invention for producing a newspaper product from at least one first and one second sub-product. The processing line 40 is composed here from the following components (as considered from right to left in the transport direction):

At the start of the processing line 40 there is an unwinder 41 for the (endless) paper roll 23. From here, the unwound paper web is transferred to the printer 42, which is routinely formed as a digital printing machine. Here, the paper web is printed with corresponding sheets of different size. The printer 42 may be adjoined by a vacuum box 43, which serves as a buffer for speed compensation.

A transverse cutter 44 is arranged downstream of the vacuum box 43 and ensures the separation of the sheets. The transverse cutter 44 is adjoined by a collator 45 (generally a drum collator), on which a stack is formed from the corresponding sheets. A gluing of the sheets forming the stack may also be carried out on the collator 45.

The stacks are then transferred from the collator 45 to a folding module 46, which is divided into a feed 46*a*, a transverse folding apparatus 46*b* (optional) and a longitudinal folding apparatus possibly having a saddle-like apparatus (in a module). The feed 46*a* should be sufficiently long (generally a number of sheet lengths) to be able to brake the incoming stack where appropriate. The folding module 46 is also joined by a conveying-away arrangement 47 for transporting away the finished newspaper products 30.

Figure 8A:
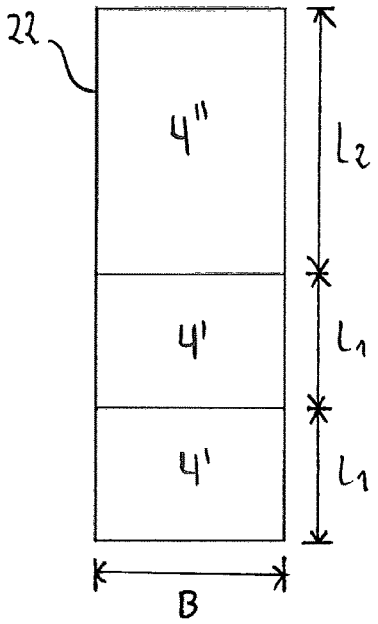

A paper web 22 is now shown schematically in FIG. 8, onto which sheets 4', 4" having a different format have already been printed. The two sheets 4' each have a length $L_1$ and the sheet 4" has a length $L_2$, the length $L_2$ being approximately twice as great as the length $L_1$ of the sheets 4'. The width B of the paper web 22 is the same in each case.

Figure 8B:
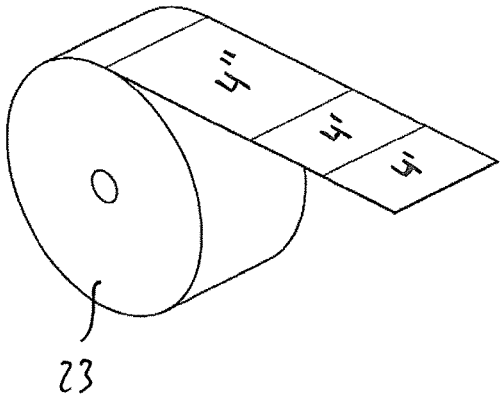

The paper web 22 is periodically unwound from a (endless) paper roll 23, as shown in FIG. 8*b*. The two sheets 4' and the approximately twice as long sheet 4" can also be seen. It is, however, also possible for the sheets 4' and 4" to be fed individually.

Figure 9:
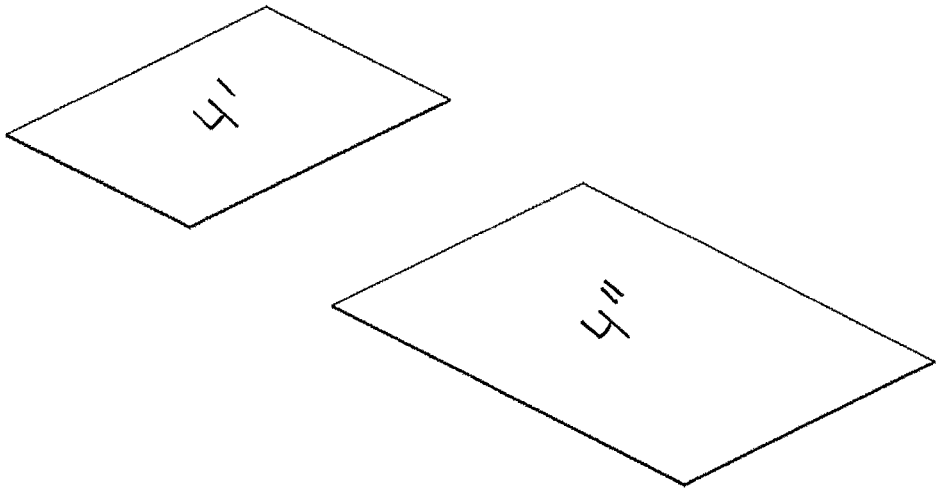
FIG. 9 shows a separated sheet for a first sub-product and a separated sheet for a second sub-product.

In FIG. 9 a separated sheet 4' and a separated sheet 4" are now shown. The separation is generally performed in the transverse cutter 44, as already presented above.

Figure 10:
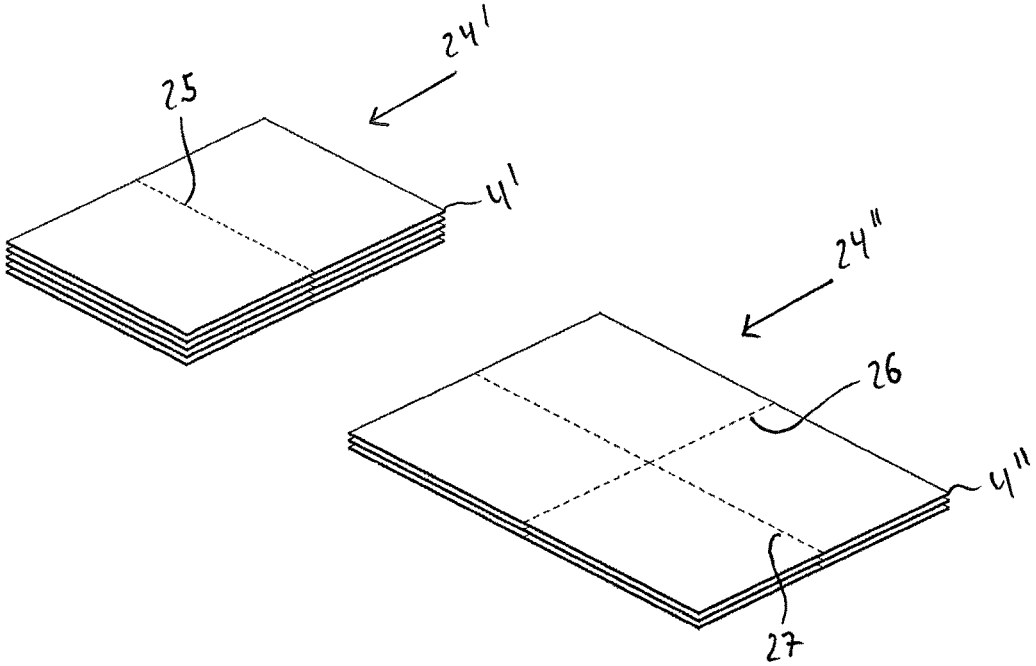
FIG. 10 shows a stack for a first sub-product and a stack for a second sub-product.

FIG. 10 illustrates a stack 24' formed from sheets 4' and a stack 24" formed from sheets 4". The stack 24' here comprises five sheets 4' and in the middle has a fold line 25 illustrated in a dashed manner. The stack 24' in the present case comprises three sheets 4" and has a fold line 26 and also a fold line 27. The individual stacks 24' and 24" are collated on the collator 45 according to FIG. 7.

Figure 11:
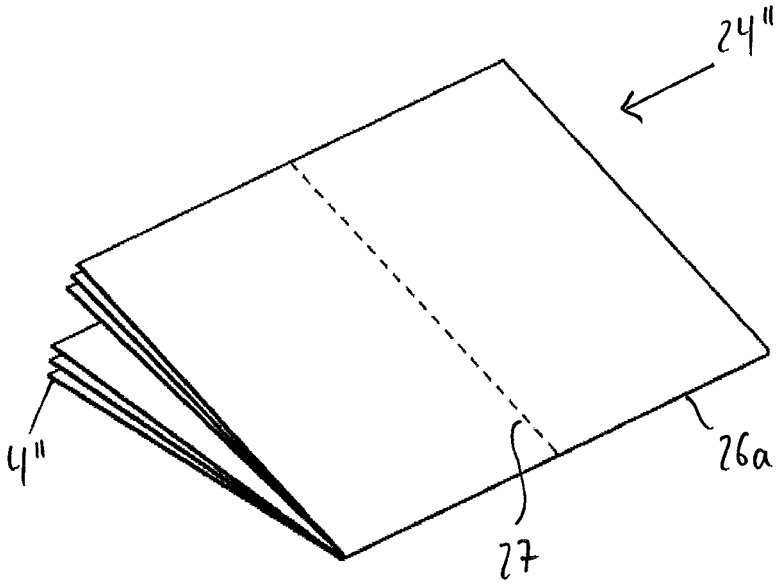
FIG. 11 shows a transversely folded stack for a second sub-product.

A stack 24' formed from three sheets 4" and folded about a transverse fold line 26 is illustrated on the basis of FIG. 11. The fold edge 26*a* was formed during the folding, and the fold line 27, which has not yet been folded, can also be seen. In the method according to the invention this step constitutes an optional intermediate step.

In FIG. 12*a* views of a first sub-product 31 of a newspaper product are now shown from three different perspectives. The first sub-product 31 is formed by the longitudinal folding of a stack 24' formed from five sheets 4' along the longitudinal fold line 25. The fold edge 25*a* is formed during this process.

FIG. 12*b* shows corresponding views of a second sub-product 32. The second sub-product 32 is formed by folding the stack 24" shown in FIG. 11 along the fold line 27. In doing so, the fold edge 27*a* is formed, which divides the fold edge 26*a* in the middle. The corresponding folding steps are carried out on the folding module 46 according to FIG. 7.

FIG. 13 schematically illustrates the sub-products 32 and 31 collated in a saddle-shaped manner to form a finished newspaper product 30. In the present case a sub-product 31 (i.e. formed from sheets 4') is inserted by way of example into four sub-products 32 (i.e. formed from sheets 4"). The finished newspaper product 30 may of course also assume any other arbitrary form, at least the outermost sub-product, however, being routinely a second sub-product 32. The folded sub-products 31, 32 may additionally also be glued to one another during the collation.

The optional method steps possibly to be performed and the time at which they are to be performed is preferably set by means of a control unit (not illustrated in FIG. 7 for reasons of simplicity): transverse fold yes/no, glue application when stacking the as yet unfolded sheets yes/no, glue application when collating the folded sub-products yes/no, weakening of the fold lines yes/no, etc.

FIG. 14 lastly shows five finished newspaper products 30 as conveyed away in the preferred stream delivery, in which the individual newspaper products 30 lie on one another in the manner of roofing tiles. The finished newspaper products 30, however, may also be conveyed away individually or as a stack. The products are conveyed away by means of the conveying-away arrangement 47, as illustrated schematically in FIG. 7.

LIST OF REFERENCE SIGNS

1 folding/transport rollers
1*a* rounded portion
1*b* cylindrical portion
1*c* flattened region
2 knife
3 transport device
3*a* conveyor belt
3*b* conveyor belt
4 sheets/sheet stack
4' sheets
4" sheets
5 belt pulleys/drive rollers
6 glue head
6*a* glue head outlet
7 light barrier
8 feed rollers
9 connection piece
10 holding rollers
11 weakening apparatus
12 fold
13 front edge
14 rear edge
19 pressing rollers
22 paper web
23 paper roll (printed)
24' stack
24" stack
25 fold line
25*a* fold edge
26 fold line
26*a* fold edge
27 fold line
27*a* fold edge
30 newspaper product
31 first sub-product
32 second sub-product
40 processing line
41 unwinder
42 printer
43 vacuum box
44 transverse cutter
45 collator
46 folding module
46*a* feed
46*b* transverse folding apparatus
46*c* longitudinal folding apparatus
47 conveying-away arrangement
A axis of rotation
E transport plane
$L_1$ length
$L_2$ length
R transport direction
S gap
X depth of penetration
α circular arc

The invention claimed is:

1. An apparatus for folding sheets or sheet stacks, comprising at least two folding/transport rollers, a transport device and a knife, the transport device defining a transport plane E for sheets or sheet stacks fed in a transport direction R, the knife being movable substantially perpendicularly to and through the transport plane E, the folding/transport rollers being arranged above the transport plane E, oppositely on both sides of the knife, an axis of rotation A of the folding/transport rollers extending substantially perpendicularly to the transport plane E, and the at least two folding/transport rollers each having, at their end facing toward the transport plane E, a rounded portion, such that a narrowing gap S is formed between the at least two folding/transport rollers, into said gap the sheets or sheet stacks can be introduced by means of the knife so as to be folded there and at the same time conveyed away in the transport direction R and wherein the knife is configured to carry out a horizontal movement during the folding process, the apparatus further comprising at least two drive rollers configured to rotate about an axis of rotation extending substantially perpendicular to the axis of rotation A of the folding/transport rollers and substantially perpendicular to the transport plane E, wherein the knife is hingedly coupled to the at least two drive rollers such that rotation of the driver rollers moves the knife through a circular path, and a component of the circular path includes the horizontal movement during the folding process.

2. The apparatus as claimed in claim 1, wherein the rounded portions of the folding/transport rollers have a spherical washer-shaped embodiment.

3. The apparatus as claimed in claim 1, wherein the folding/transport rollers are spring-mounted transversely to the transport direction R.

4. The apparatus as claimed in claim 1, wherein the knife is hinged to at least two drive rollers.

5. The apparatus as claimed in claim 4, wherein the drive rollers are driven at constant rotational speed during the folding process.

6. The apparatus as claimed in claim 1, wherein a depth of penetration X of the knife into the gap S formed between the folding/transport rollers is approximately 5 to 10 mm.

7. The apparatus as claimed in claim 1, wherein the transport device is embodied in form of two conveyor belts running parallel to one another.

8. The apparatus as claimed in in claim 1, wherein a glue head is arranged downstream of the folding/transport rollers.

9. The apparatus as claimed in claim 1, wherein a light barrier is arranged upstream of the folding/transport rollers for detection of a rear edge of a sheet or a sheet stack.

10. The apparatus as claimed in claim 9, wherein the detection of the rear edge of a sheet or a sheet stack triggers a movement of the knife.

* * * * *